US008695700B2

(12) United States Patent
Gette et al.

(10) Patent No.: US 8,695,700 B2
(45) Date of Patent: Apr. 15, 2014

(54) SEAL WITH ENHANCED NOSE RING

(75) Inventors: Nicholas P. Gette, Houston, TX (US); Carl Boehm, Jr., Houston, TX (US)

(73) Assignee: Vetco Gray Inc., Houston, TX (US)

( * ) Notice: Subject to any disclaimer, the term of this patent is extended or adjusted under 35 U.S.C. 154(b) by 440 days.

(21) Appl. No.: 13/088,087

(22) Filed: Apr. 15, 2011

(65) Prior Publication Data

US 2012/0085554 A1 Apr. 12, 2012

Related U.S. Application Data

(60) Provisional application No. 61/391,477, filed on Oct. 8, 2010.

(51) Int. Cl.
*E21B 23/01* (2006.01)
*E21B 43/10* (2006.01)

(52) U.S. Cl.
USPC ..... 166/208; 166/217; 166/379; 277/328

(58) Field of Classification Search
USPC ..... 166/208, 217, 379; 277/328
See application file for complete search history.

(56) References Cited

U.S. PATENT DOCUMENTS

| | | | | |
|---|---|---|---|---|
| 4,742,874 | A | 5/1988 | Gullion | |
| 4,932,472 | A | 6/1990 | Boehm, Jr. | |
| 4,949,787 | A | 8/1990 | Brammer et al. | |
| 5,456,314 | A | 10/1995 | Boehm, Jr. et al. | |
| 7,762,319 | B2 | 7/2010 | Nelson | |
| 2010/0116489 | A1 | 5/2010 | Nelson | |
| 2010/0126736 | A1 | 5/2010 | Ellis et al. | |
| 2010/0147533 | A1 | 6/2010 | Nelson | |
| 2012/0241162 | A1 * | 9/2012 | Yates et al. | 166/348 |

OTHER PUBLICATIONS

GB Search Report issued Nov. 17, 2011 from corresponding Application No. GB1117045.3.

* cited by examiner

*Primary Examiner* — Giovanna Wright
(74) *Attorney, Agent, or Firm* — Bracewell & Giuliani LLP

(57) ABSTRACT

A seal assembly between a wellhead housing having a bore and a casing hanger, has an inner seal leg for sealing against hanger and an outer seal leg for sealing against housing. An extension extends downward from outer seal leg and is connected to a nose ring having a downward facing shoulder that rests on the hanger shoulder to provide a reaction point for setting operations. A lock ring is retained within interior portion of the nose ring. An upward facing shoulder formed on an upper portion of nose ring contacts the lower surface of the inner seal leg. The shoulder prevents the downward deflection of the inner leg and eliminates buckling due to Poisson effect from the resulting axial force due to growth of the seal legs during setting operations. The shoulder thus prevents crooked or twisted setting of the seal to prevent plastic strain in the seal.

14 Claims, 5 Drawing Sheets

SEAL WITH ENHANCED NOSE RING

CROSS-REFERENCE TO RELATED APPLICATION

This application claims priority to provisional application 61/391,477, filed Oct. 8, 2010.

FIELD OF THE INVENTION

This invention relates in general to wellhead assemblies and in particular to a seal nose ring that improves tolerance to hanger movement.

BACKGROUND OF THE INVENTION

Seals are used between inner and outer wellhead tubular members to contain internal well pressure. The inner wellhead member may be a casing hanger located in a wellhead housing and that supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member.

A variety of seals located between the inner and outer wellhead members have been employed in the prior art. Prior art seals include elastomeric and partially metal and elastomeric rings. Prior art seal rings made entirely of metal for forming metal-to-metal seals ("MS") are also employed. The seals may be set by a running tool, or they may be set in response to the weight of the string of casing or tubing. One type of prior art metal-to-metal seal has seal body with inner and outer walls separated by a cylindrical slot, forming a "U" shape. An energizing ring is pushed into the slot in the seal to deform the inner and outer walls apart into sealing engagement with the inner and outer wellhead members, which may have wickers formed thereon. The energizing ring is typically a solid wedge-shaped member. The deformation of the seal's inner and outer walls exceeds the yield strength of the material of the seal ring, making the deformation permanent.

During setting of the seal, the imparted forces may cause a seal leg to deflect downwards relative to the other seal leg. This can introduce plastic strain into the seal, making it susceptible to tear or shear when the casing hanger moves. To address this problem, a threaded connection has been utilized below the seal that connects a nose ring to the seal. The nose ring has a thin, annular tab, that protrudes upward and contacts the inner seal leg. This tab is supposed to resist the setting forces imparted to it when the energizing ring is driven into the seal to thereby prevent the inducement of plastic strain due to inner seal leg deflection.

This same tab is also designed to buckle during pressure testing of the seal and/or BOP stack with a plug-type or isolation tool. During pressure testing a large force, up to several million pounds, is transferred to the top of the casing hanger. This force causes the casing hanger to deflect downwards, carrying with it the inner seal leg, which is engaged to it. At this point the tab is supposed to buckle, allowing independent movement of the inner and outer seal legs. If the legs were rigidly coupled to each other, the seal body would be torn in half from the large load and deflections created by the pressure test. Even with a buckling tab, eventually the relative displacements between the inner and outer seal legs may become so great that the seal will shear itself apart. To limit this relative displacement, test pressures may be lowered, complex load mechanisms on each hanger position may be added instead of a simple stacking arrangement, or wickers may be entirely abandoned on the casing hanger side of the seal in a "slick neck" arrangement. These approaches compromise the robustness of the system.

The annular tab, however, may buckle prematurely due to Poisson effect, which is the tendency of a material to expand in directions perpendicular to the applied compression. In practical applications, the large radial interference between the energizing ring and each of the seal legs causes the seal legs to grow downwards due to the Poisson effect. Because a large radial force is required to effect a gas-tight seal to high pressures, the resulting axial force due to the growth of the seal legs is also high and sufficient to cause the tab to buckle. This premature buckling of the tab may result in a crooked or twisted installation of the seal body and increased plastic strains in the area that MS-type seals typically fail due to excessive hanger movement during pressure testing. To deal with this type of problem, an active hanger with complex mechanisms in the third position could be used. This option however is costly and complex.

A need exists for a technique that addresses the seal problems described above. In particular, a need exists for a technique to make seals more tolerant to increased hanger movement by accounting for Poisson effect in the seal legs. The following technique may solve these problems.

SUMMARY OF THE INVENTION

A seal assembly is located between a wellhead housing having a bore and a casing hanger. Housing is typically located at an upper end of a well and serves as an outer wellhead member. The casing hanger has an upward facing shoulder for supporting a lower portion of the seal assembly. A metal-to-metal seal assembly has an inner seal leg with and inner wall sealing against the cylindrical wall of casing hanger and an outer seal leg with an outer wall surface that seals against wellhead housing bore. The seal legs form a U-shaped pocket or slot. An extension extends downward from the outer seal leg and is connected to a nose ring having a downward facing shoulder that rests on the casing hanger shoulder to provide a reaction point for setting operations.

A lock ring retained within a recess formed in an upper interior portion of the nose ring holds the seal to the nose ring and allows for retrieval. An upward facing shoulder formed on an upper portion of the nose ring contacts the lower surface of the inner seal leg. The upward facing shoulder is contacted by the lower surface during setting operations and resists the forces exerted during setting operations to prevent the downward deflection of the inner leg. Although high, this axial force is not sufficient to buckle the shoulder during setting.

The shoulder also eliminates any buckling due to Poisson effect from the resulting axial force due to the growth of the seal legs during setting operations. The shoulder creates a solid platform that prevents crooked or twisted setting of the seal and thereby prevents plastic strain in the seal. Further, the shoulder does not buckle during pressure testing and a gap is provided between a lower surface of the seal extension and an upward facing mating surface of the nose ring that may range between 0.020 to 0.050 inches depending on the application and materials. The gap closes up during setting operations.

The invention advantageously reduces plastic strains induced during installation when compared to the prior art.

DETAILED DESCRIPTION OF THE INVENTION

Figure 1:
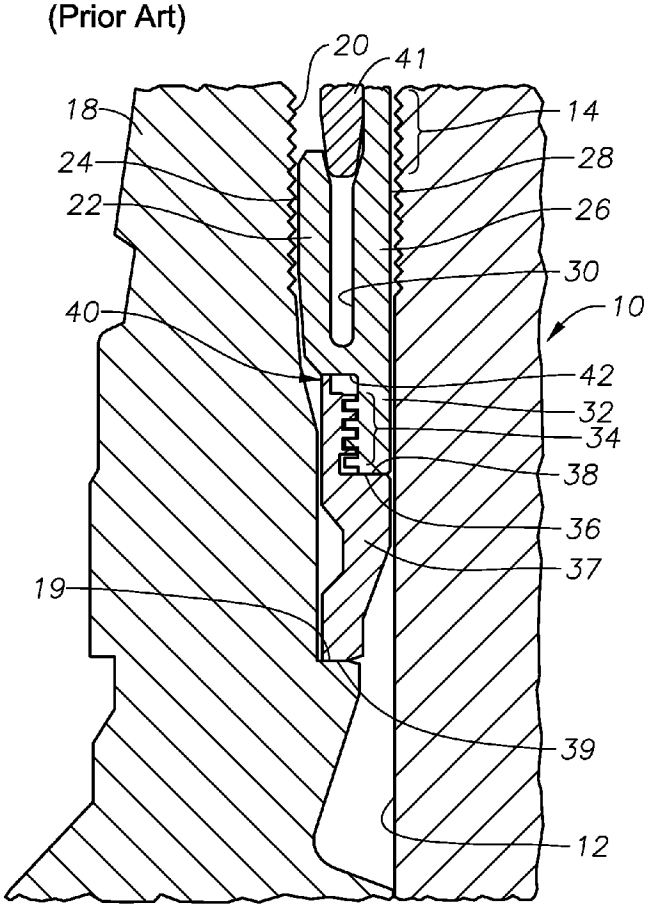
Fig. 1 (Prior Art)
FIG. 1 is a sectional view of a seal assembly of the prior art with the energizing ring locked to the seal, but unset.

Referring to FIG. 1, a portion of a seal assembly in the prior art is shown between a wellhead housing 10 having a bore 12 with wickers 14 formed thereon and a casing hanger 18 with wickers 20 formed on an exterior portion. Housing 10 is typically located at an upper end of a well and serves as an outer wellhead member 10. The casing hanger 18 has an upward facing shoulder 19 for supporting a lower portion of the seal assembly. A metal-to-metal seal assembly has an inner seal leg 22 with and inner wall 24 sealing against the cylindrical wall of casing hanger 18. Seal ring has an outer seal leg 26 with an outer wall surface 28 that seals against wellhead housing bore 12. The wall surfaces 24, 28 may be curved and smooth. The seal legs 22, 26 form a U-shaped pocket or slot 30. An extension 32 extends downward from the outer leg 26 and has a threaded connection 34. The extension 32 has a downward facing shoulder 36 that rests on an upward facing shoulder 38 formed on a nose ring 37. The threaded connection 34 connects the seal ring to the nose ring 37. A lower portion 39 of the nose ring rests on the upward facing shoulder 19 of the casing hanger 18 to provide a reaction point during setting operations. An annular tab 40 protrudes upward from the nose ring 37 at a point above the threaded connection 34. The annular tab 40 contacts a lower surface 42 of the inner seal leg 22.

Figure 2:
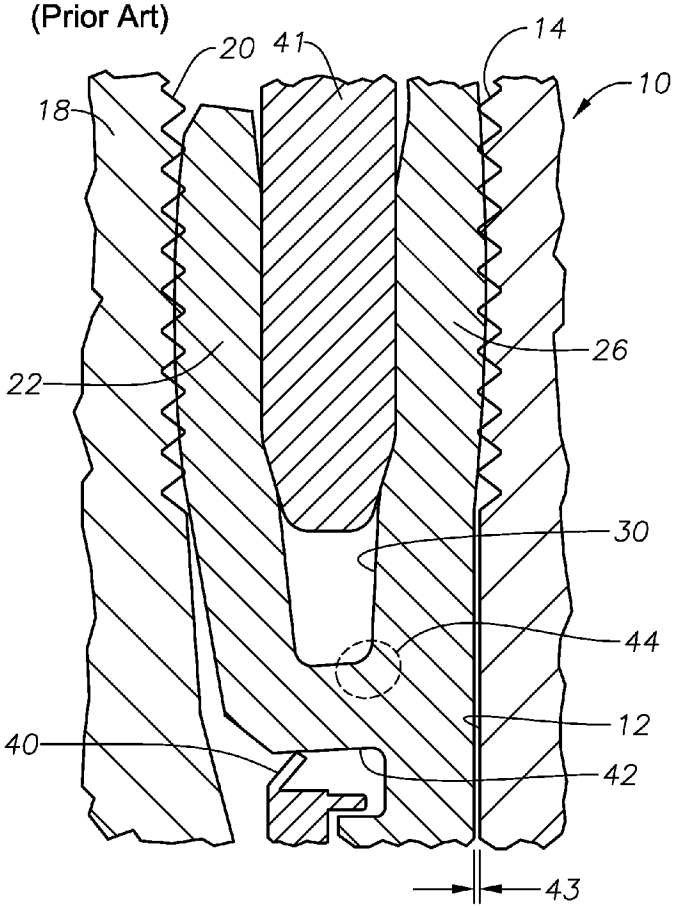
Fig. 2 (Prior Art)
FIG. 2 is a sectional view of a seal assembly of the prior art set between outer and inner wellhead members and the annular tab buckled.
Figure 7:
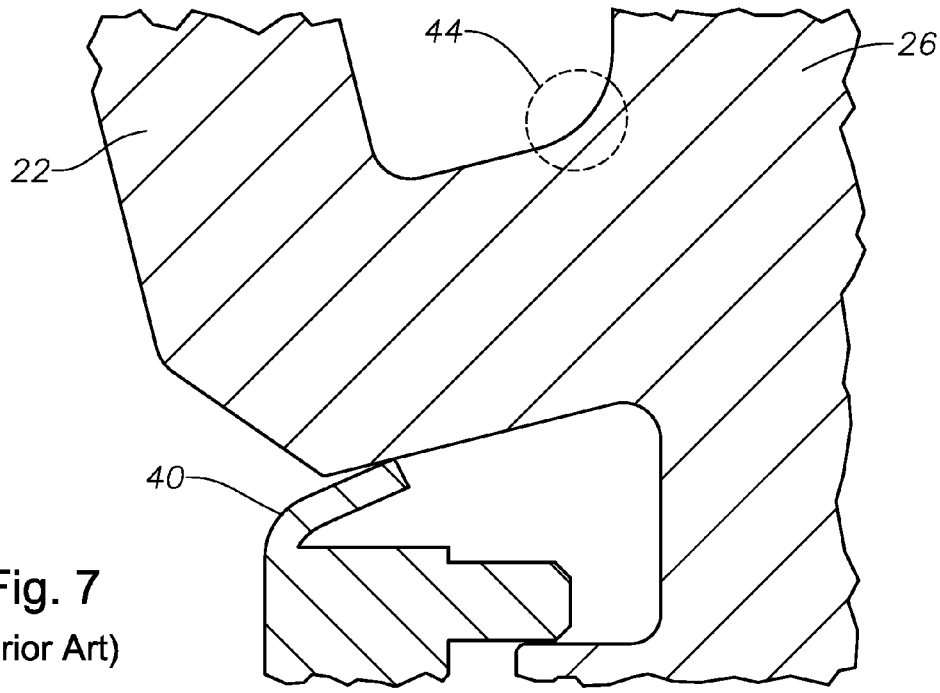
Fig. 7 (Prior Art)
FIG. 7 is a sectional view of the seal assembly of the prior art illustrating plastic strain in the seal.

Continuing to refer to the prior art seal assembly in FIG. 1, an energizing ring 41 is typically forced downward by a running tool or the weight of a string to force it into the slot 30. The energizing ring 41 deforms the inner and outer seal legs 22, 26 of the seal body against the outer wellhead member 10 and the inner wellhead member 18. As previously explained, the annular tab 40 resists deflection of the inner leg 22 due to the setting force. The annular tab 40 is designed to buckle during pressure testing of the seal. However, as shown in FIG. 2, the annular tab 40 may buckle prematurely due to the Poisson effect, which is the tendency of a material to expand in directions perpendicular to the applied compression. The large radial interference between the energizing ring 41 and each of the seal legs 22, 26 causes the seal legs to grow downwards due to this phenomena. Because a large radial force is required to effect a gas-tight seal to high gas pressures, the resulting axial force due to the growth of the seal legs 22, 26 is also high and sufficient to cause the tab 40 to buckle. This premature buckling of the tab may result in a crooked or twisted installation of the seal body and increased plastic strains in the pocket area 44 that MS-type seals typically fail due to excessive hanger 18 movement during pressure testing, as shown in FIG. 7.

Figure 3A:
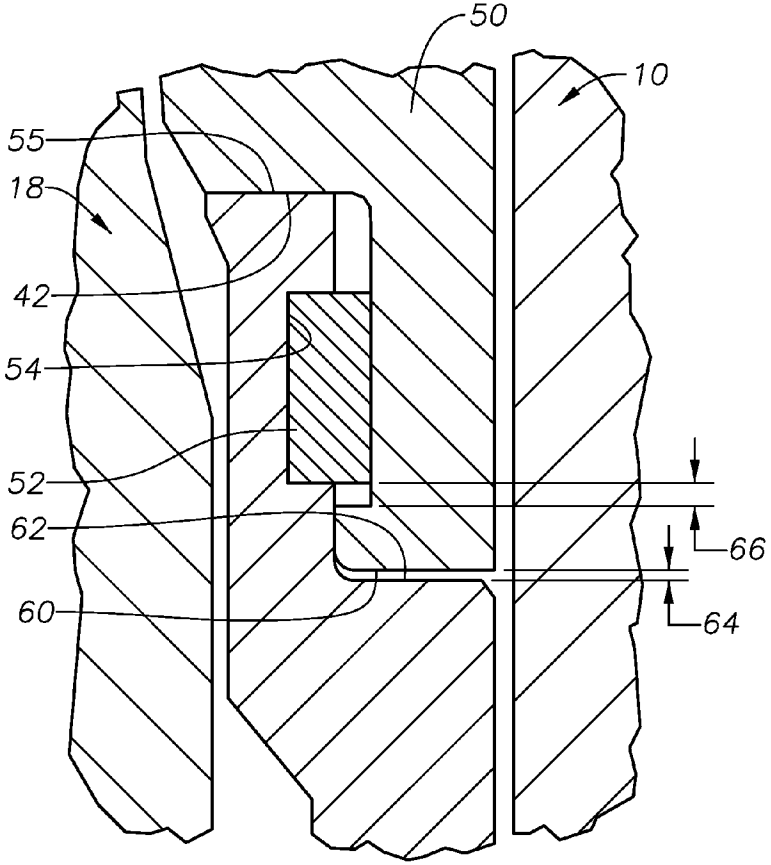
FIG. 3A is an enlarged sectional view of the seal assembly in FIG. 3, in accordance with an embodiment of the invention.
Figure 3:
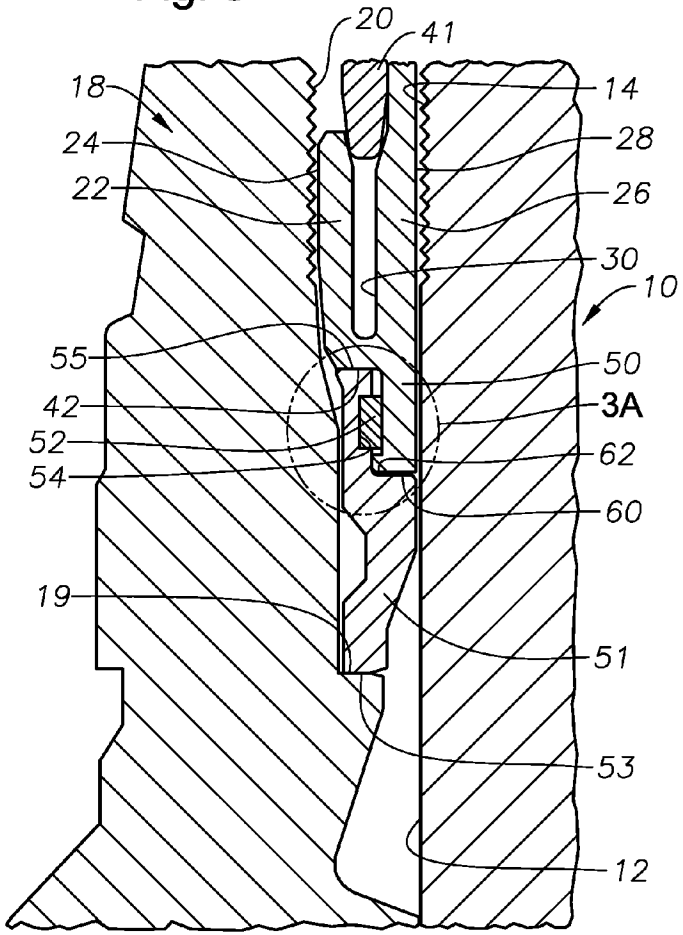
FIG. 3 is a sectional view of a seal assembly with the energizing ring locked to the seal, but unset, in accordance with an embodiment of the invention.

Referring to FIG. 3, an embodiment of the invention shows a portion of the high pressure wellhead housing 10. As in the prior art, the housing 10 is located at an upper end of a well and serves as an outer wellhead member in this example. Housing 10 has a bore 12 located therein.

In this example, the inner wellhead member comprises a casing hanger 18, which is shown partially in FIG. 2 within bore 12. Alternately, wellhead housing 10 could be a tubing spool or a Christmas tree and casing hanger 18 could instead be a tubing hanger, plug, safety valve, or other device. As in the prior art, the energizing ring 41 is typically forced downward by a running tool (not shown) or the weight of a string (not shown) to force the energizing ring 41 into the slot 30. The energizing ring 41 deforms the inner and outer seal legs 22, 26 of the seal body against the outer wellhead member 10 and the inner wellhead member 18. The inner and outer wall surfaces 24, 28 sealingly engage the wicker profiles 14, 20 formed on the housing 10 and hanger 18.

Figure 4:
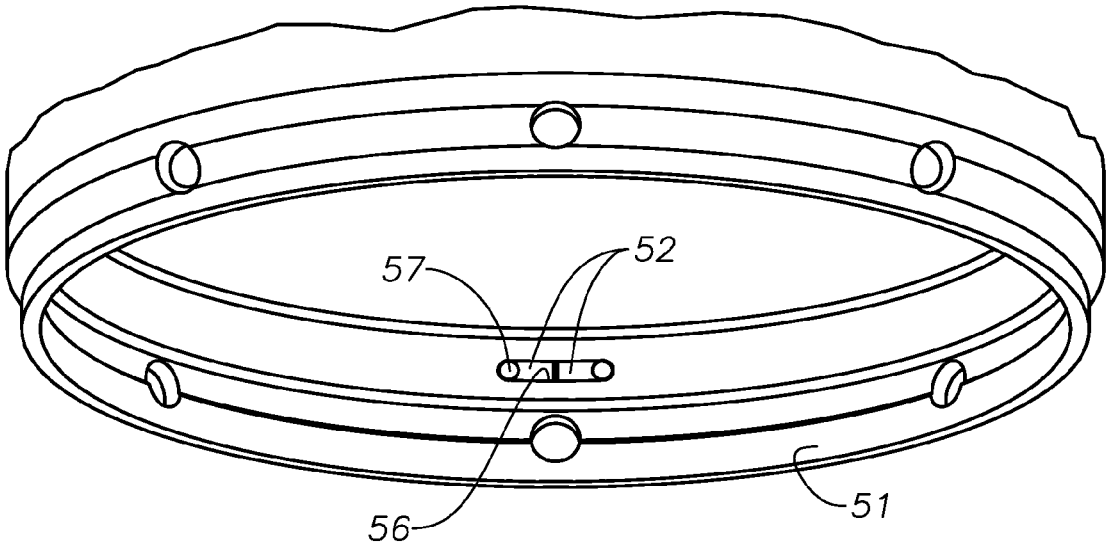
FIG. 4 is a perspective view of a portion of the seal assembly of FIG. 3, in accordance with an embodiment of the invention.
Figure 5:
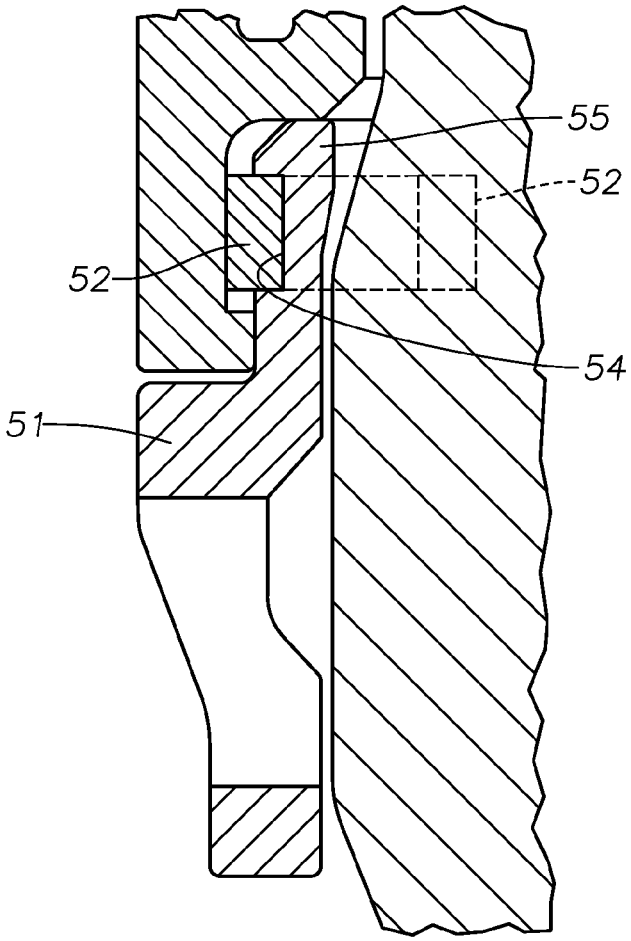
FIG. 5 is a sectional view of the seal assembly of FIG. 4, in accordance with an embodiment of the invention.

The invention departs from the prior art with respect to features located below the seal. In this example, an extension extends downward from the outer seal leg 26 and is connected to a nose ring 51 having a downward facing shoulder 53 that rests on shoulder 19 of the casing hanger 18 to provide a reaction point for setting operations. A lock ring 52 that is retained within a recess 54 formed in an upper interior portion of the nose ring 51, holds the seal to the nose ring 51 and allows for retrieval. The lock ring 52 replaces the threaded connection 34 (FIG. 1) of the prior art. The lock ring 52 in this example is segmented, with a plurality of lock ring segments 52 being fed through a slot 56 (FIG. 5) formed in the inner diameter of the nose ring 51 until the circumference of the nose ring 51 is filled with the segments 52. To ensure that the lock ring segments 52 do not fall out of the nose ring 51, segments 52 visible through the slot 56 may be fastened to the nose ring 51 by cap screws 57, as shown in FIGS. 4 and 5. Segments 52 extend completely around the circumference of nose ring 51. In one embodiment, there are sixteen segments 52. Each segment 52 is an arcuate portion of a ring. Alternatively, the lock ring 52 may be formed from a single piece that is bent during installation to conform to the circumference of the nose ring 51.

Figure 6:
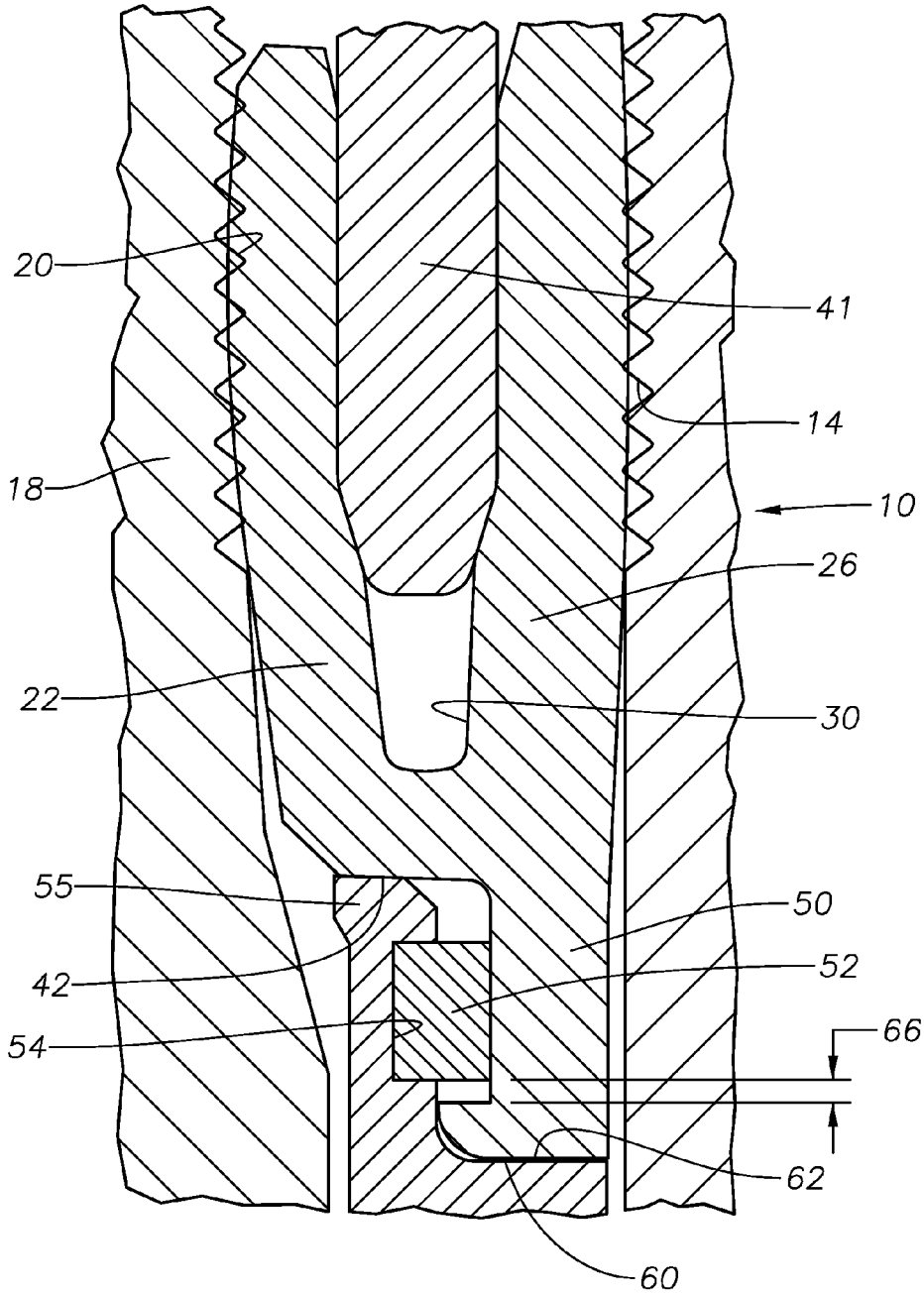
FIG. 6 is a sectional view of the seal assembly of FIG. 3 between outer and inner wellhead members in the set position, in accordance with an embodiment of the invention.
Figure 8:
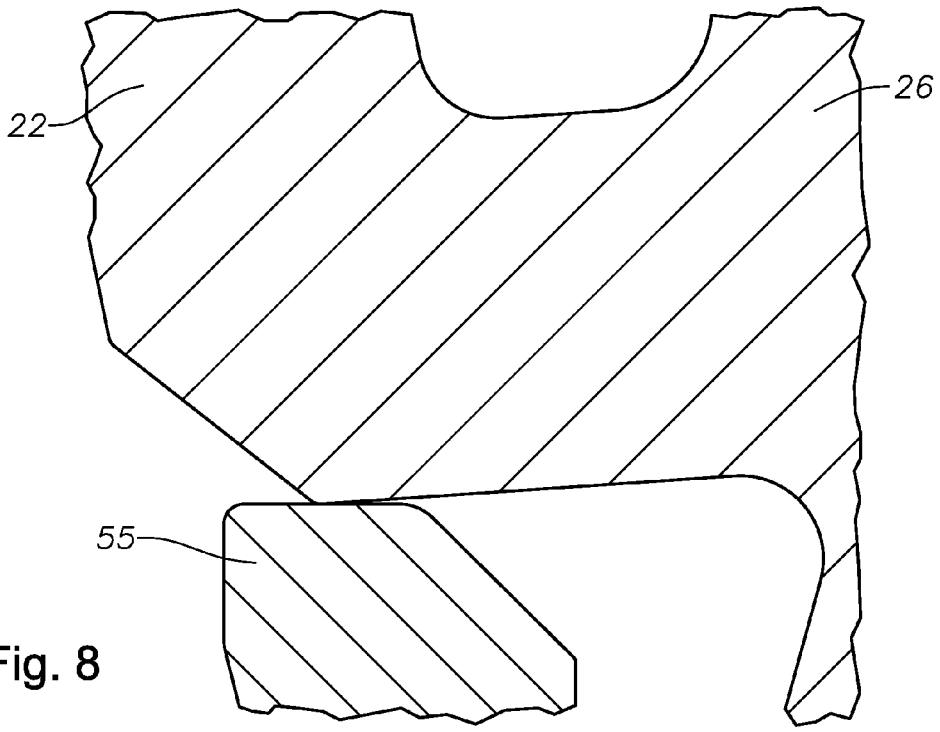
FIG. 8 is a sectional view of the seal assembly illustrating prevention of plastic strain in the seal, in accordance with an embodiment of the invention.

Continuing to refer to FIG. 3, an upward facing shoulder 55 formed on an upper portion of the nose ring 51 contacts the lower surface 42 of the inner seal leg 22. The shoulder 55 has a larger area than the tab 40 (FIG. 1) of the prior art that it replaces. The upward facing shoulder 55 is contacted by surface 42 during setting operations and resists the forces exerted during setting operations to prevent the downward deflection of the inner leg 22. The shoulder 55 also eliminates any buckling due to Poisson effect because the resulting axial force due to the growth of the seal legs 22, 26 during setting operations. Although high, this axial force is not sufficient to buckle the shoulder 55 during setting. This results in a solid platform that prevents crooked or twisted setting of the seal and thereby prevents plastic strain in the seal, as shown in FIGS. 6 and 8. Further, the shoulder 55 will not buckle during pressure testing, unlike the tab 40 (FIG. 2) of the prior art. In addition, to accommodate downward growth of the seal body associated with Poisson effect during setting operations, a gap 64 (FIG. 3A) is provided between a lower surface 60 of the seal extension 50 and an upward facing mating surface 62 of the nose ring 51. The gap 64 may range between 0.020 to 0.050 inches depending on the application and materials and will close up during setting operations.

In this embodiment, the lock ring 52 retained within the recess 54 formed in the nose ring 51 also provides a set amount of float or space 66 (FIG. 3A) between the nose ring 51 and the seal body. As previously explained, during pressure testing, a large force is transferred to the top of the casing hanger 18 that causes the casing hanger 18 to deflect downwards, carrying with it the inner seal leg 22. The space 66 between the nose ring 51 and the seal body completely decouples the nose ring 51 from the seal body during these pressure tests by preventing the lock ring 52 from coming into contact with the seal extension 50 when the hanger 18 and inner seal leg 22 move downwards during testing.

The end result of this arrangement is that plastic strains are greatly reduced at installation when compared to the prior art. Due to the enhancements in the nose ring 51, the annulus seal can now advantageously tolerate an increased range of hanger 18 deflections, simplifying the system architecture, and allow for higher test pressures.

Further, this invention removes the need for an expensive Inconel® hanger in the third position, which would require its own specific MS-type seal as well as MS-emergency type seals. Instead, a single part maybe used for all three hanger positions. In addition, this invention permits the use of MS-type seals where only wickerless-type seals could be supplied. The wicker type seals are greatly preferred due to their ability to minimize axial movement of the seal legs with respect to the outer and inner wellhead members.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A wellhead assembly with an axis, comprising:

an outer wellhead member having a bore;

an inner wellhead member adapted to be located in the bore;

opposing seal surfaces in the bore and on an exterior portion of the inner wellhead member;

a seal ring between the inner and outer wellhead members having an inner annular member and an outer annular member circumscribing a portion of the inner annular member, wherein the seal ring comprises a downward extension extending from below the outer annular member of the seal ring;

an annular energizing ring having a lower end insertable between the inner and outer annular members of the seal ring, so that when the lower end of the energizing ring is inserted between the inner and outer annular members of the seal ring, outer walls of the inner and outer annular members of the seal ring are urged radially outward into sealing engagement with the inner and outer wellhead members;

an annular extension extending downwards and located below the seal ring, the extension having a lower surface for landing on a portion of the inner wellhead member and having an upward facing shoulder in contact with the inner annular member of the seal ring to prevent downward deflection of the inner annular member as the energizing ring is inserted between the inner and outer annular members of the seal ring; and a locking member having at least a portion retained within a recess formed in an upper interior portion of the annular extension to hold the seal ring to the annular extension and allow for axial movement of the annular extension relative to the downward extension of the seal ring.

2. The assembly according to claim 1, wherein a gap exists between a lower end of the downward extension and an upward facing shoulder on the annular extension, prior to setting.

3. The assembly according to claim 1, wherein the annular inner member of the seal ring is rigidly secured to the inner wellhead member after the seal is set.

4. The assembly according to claim 3, wherein the inner wellhead member comprises a set of wickers formed on the seal surfaces, wherein the annular inner member of the seal ring is rigidly secured to the inner wellhead member by the sealing engagement of the annular inner member of the seal ring with the set of wickers formed on the seal surface of the inner wellhead member.

5. The assembly according to claim 1, wherein the inner and outer annular members of the seal ring form a U-shaped pocket.

6. The assembly according to claim 5, wherein the inner wellhead member comprises a shoulder projecting radially outward to allow the annular extension below the seal ring to land, the shoulder providing a reaction point during setting operations.

7. A seal assembly, comprising:

a seal ring between inner and outer wellhead members, the seal ring having an inner annular member and an outer annular member circumscribing a portion of the inner annular member;

an annular energizing ring having a lower end insertable between the inner and outer annular members of the seal ring, so that when the lower end of the energizing ring is inserted between the inner and outer annular members of the seal ring, outer walls of the inner and outer annular members of the seal ring are urged radially outward into saline engagement with opposing seal surfaces on the inner and outer wellhead members;

an annular extension extending downwards and located below the seal ring, the extension having a lower surface for landing on a portion of the inner wellhead member and having an upward facing shoulder in contact with the inner annular member of the seal ring to prevent downward deflection of the inner annular member during setting operations; and a locking member having at least a portion retained within a recess formed in an upper interior portion of the annular extension to hold the seal ring to the annular extension and allow for retrieval of seal assembly.

8. The assembly according to claim 7, further comprising a downward extension extending from below the outer annular member of the seal ring.

9. The assembly according to claim 8, wherein a gap exists between a lower end of the downward extension and an upward facing shoulder on the annular extension, prior to setting.

10. The assembly according to claim 9, wherein the gap is between 0.020 to 0.050 inches.

11. The assembly according to claim 7, wherein the inner and outer annular members of the seal ring form a U-shaped pocket.

12. The assembly according to claim 7, wherein a set of wickets is formed on at least one of the seal surfaces.

13. The assembly according to claim 7, wherein the inner wellhead member comprises a shoulder projecting radially outward to allow the annular extension below the seal ring to land, the shoulder providing a reaction point during setting operations.

14. A method for sealing an inner wellhead member to an outer wellhead member, comprising:

landing a seal assembly between the inner and outer wellhead members; the seal having an inner leg and a separate outer leg, a slot therebetween, and an extension extending downward from the seal for landing;

driving an energizing ring into a slot in the seal assembly to urge inner and outer legs of the seal assembly into engagement with the inner and outer wellhead members;

supporting the inner leg of the seal assembly with an upward facing extension to prevent buckling of the inner leg during setting operations; and securing the extension to the seal with a locking member having at least a portion retained within a recess formed in a upper interior portion of the extension to hold the seal to the annular extension and allow for axial movement of the extension relative to the seal ring.

* * * * *